US012583644B2

(12) United States Patent
Casini Ropa et al.

(10) Patent No.: US 12,583,644 B2
(45) Date of Patent: Mar. 24, 2026

(54) WRAPPING MACHINE

(71) Applicant: AETNA GROUP S.P.A., Verucchio (IT)

(72) Inventors: Davide Casini Ropa, Verucchio (IT); Andrea Renzini, Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 435 days.

(21) Appl. No.: 18/037,195

(22) PCT Filed: Nov. 12, 2021

(86) PCT No.: PCT/IB2021/060494

§ 371 (c)(1),
(2) Date: May 16, 2023

(87) PCT Pub. No.: WO2022/101838

PCT Pub. Date: May 19, 2022

(65) Prior Publication Data

US 2023/0415939 A1 Dec. 28, 2023

(30) Foreign Application Priority Data

Nov. 16, 2020 (IT) ..... 102020000027420

(51) Int. Cl.
*B65B 41/16* (2006.01)
*B65H 19/12* (2006.01)

(52) U.S. Cl.
CPC ..... *B65B 41/16* (2013.01); *B65H 19/12* (2013.01); *B65H 2402/54* (2013.01); *B65H 2801/81* (2013.01)

(58) Field of Classification Search
CPC ..... B65H 19/12; B65H 2402/54; B65H 2801/81; B65B 41/12; B65B 41/16
See application file for complete search history.

(56) References Cited

U.S. PATENT DOCUMENTS 5,593,107 A 1/1997 Focke et al.
5,653,087 A 8/1997 Spada et al.
(Continued)

FOREIGN PATENT DOCUMENTS

CN 108502227 9/2018
EP 0 644 140 3/1995
(Continued)

OTHER PUBLICATIONS

International Search Report issued Mar. 28, 2022 in corresponding International Application No. PCT/IB2021/060494.
(Continued)

*Primary Examiner* — Sang K Kim
(74) *Attorney, Agent, or Firm* — Wenderoth, Lind & Ponack, L.L.P.

(57) ABSTRACT

A wrapping machine includes an unwinding apparatus having a reel holder shaft and a system for removing from the unwinding apparatus a core of a film reel. The reel holder shaft includes a lower end having an abutment arm movable between an open configuration to support the core and a closed configuration to allow removing or inserting of the core. The system has a removing apparatus including a supporting element with a side wall having elastic elements forming an internal cavity having an upper opening and an upper peripheral edge which defines a supporting surface for supporting the core when the lower end of the reel holder shaft is inserted into the internal cavity. The elastic elements are configured to elastically bend and open wide when abutted by the abutment arm in the open configuration to enable the lower end entering the internal cavity.

14 Claims, 5 Drawing Sheets

(56) References Cited

U.S. PATENT DOCUMENTS

| | | | | |
|---|---|---|---|---|
| 10,793,384 | B2 * | 10/2020 | Nagafuchi | B65H 19/12 |
| 12,037,212 | B2 * | 7/2024 | Cere' | B65H 23/188 |
| 2002/0038838 | A1 * | 4/2002 | Marois | B65H 16/06<br>242/596.6 |
| 2010/0025517 | A1 | 2/2010 | Cere | |

FOREIGN PATENT DOCUMENTS

| | | |
|---|---|---|
| EP | 2 019 061 | 1/2009 |
| JP | 5-22437 | 3/1993 |

OTHER PUBLICATIONS

Office Action issued Jul. 24, 2025 in corresponding Chinese Patent Application No. 202180077097.4, with English-language Translation.

* cited by examiner

WRAPPING MACHINE

The invention relates to machines for wrapping a load with an extensible plastic film and in particular to a wrapping machine provided with a system for removing a depleted film reel, and more precisely the core or central cylindrical element around which the plastic film is wrapped to form the reel.

The known wrapping machines comprise an unwinding apparatus which is movable along and/or about a winding axis and which supports a reel of film from which the film is unwound to be wrapped around the load so as to form a series of strips or bands generally having a helical trend, by virtue of the combination of the relative linear and rotational movements between the unwinding apparatus and the load.

In wrapping machines provided with a rotating table to support the load, during the wrapping cycle the latter is rotated about a vertical winding axis, while the unwinding apparatus is moved parallel to the winding axis with alternating motion along a fixed upright of the wrapping machine.

In wrapping machines with horizontal rotating ring or rotating arm, the load remains static during the wrapping, while the unwinding apparatus is moved with respect to the latter both in rotation about a vertical winding axis and in translation parallel to the latter. To this end, the unwinding apparatus is fixed to a ring structure or to an arm rotatably supported by a machine frame and so as to rotate around the load.

The unwinding apparatus substantially comprises a support frame, fixed to the rotating ring or arm or slidably connected to the fixed upright, which rotatably supports a reel holder shaft on which the film reel is mounted, a pair of pre-stretch rollers for stretching and unwinding the film and one or more guide rollers for diverting the film towards the load during the unwinding.

The film of plastic material is unwound by the reel and wrapped around the aforesaid rollers according to a path which allows a correct unwinding and a desired pre-stretch or elongation.

If the film is depleted, the reel must be replaced with a new reel. More precisely, the elongated core or central element, of cardboard or plastic, around which the plastic film was wrapped, must be removed.

Such a replacement procedure is generally performed manually by one or more operators who, after stopping the machine and positioning the unwinding unit at an appropriate height from the ground, proceed to remove the core of the depleted reel from the relative reel holder shaft and then insert and lock the new film reel.

In some high-performance wrapping machines, in particular horizontal rotating ring wrapping machines, the replacement procedure is performed automatically without the intervention of operators. For this purpose, the wrapping machine is provided with a system capable of removing and receiving the core of the depleted film reel from the reel holder shaft of the unwinding apparatus and mounting on the reel holder shaft a new film reel taken from a carriage or support positioned on the machine.

Some known reel core removal or extraction systems envisage reel holder shafts of the wrapping machine comprising a cylindrical body having an external diameter slightly smaller than the internal diameter of the reel core, an upper end which is fixed to the supporting frame of the unwinding apparatus and a lower end which is provided with a pair of opposite and movable brackets or supporting arms in rotation. In particular, the two arms are rotatable together at the same time between a closed or folded configuration and an open or unfolded configuration.

In the open configuration, the two arms are arranged protruding from opposite sides outwards with respect to the cylindrical body and in a substantially horizontal position so as to form a support for the film reel inserted on the reel holder shaft. More precisely, in the open configuration the two arms abut and support the film reel core.

In the closed configuration, the two arms are instead folded towards the inside of the reel holder shaft in an almost vertical position so as not to protrude externally from the cylindrical body and have in particular a radial transverse dimension, i.e., in a direction perpendicular to a longitudinal rotation axis of the reel holder shaft, i.e., almost horizontal, smaller than the external diameter of the cylindrical body and the internal diameter of the reel core so as to allow the removal or insertion thereof.

The removal system then comprises a removing apparatus adapted to interact with this type of reel holder shaft and is provided with a supporting element having a hollow cylindrical cup-like shape. More precisely, the supporting element is open at the top so as to receive therein, during the removal procedure, the lower end of the reel holder shaft with the arms arranged in the open configuration and disengaged and spaced from a lower edge of the aforesaid core so as to support the latter.

The supporting element has in particular an upper peripheral edge, substantially circular, arranged around the opening and having dimensions such as to abut and support the reel core during the removal procedure.

In particular, the upper peripheral edge of the supporting element has an internal diameter greater than the radial transverse dimension of the two arms arranged in the open configuration, to allow the insertion of the reel holder shaft, and an external diameter such that the width of the upper peripheral edge forms a flat supporting surface (circular crown) capable of stably supporting the reel core. In fact, the external diameter of the core is generally comprised between the internal diameter and the external diameter of the upper peripheral edge of the supporting element.

During the automated reel core removal procedure, the machine unwinding apparatus is lowered so that the lower end of the reel holder shaft can be inserted inside the supporting element by a length which allows the arms to be disengaged from the core so that they can be rotated in the closed configuration. The reel core is supported and maintained raised by the outer edge of the supporting element.

With the arms in the closed configuration, the unwinding apparatus can be lifted vertically so as to disengage the reel holder shaft from the reel core which remains resting on the supporting element. The latter can be mounted on a special mobile frame approaching or moving away from an operative area of the wrapping machine in order not to obstruct the wrapping procedure.

A disadvantage of the known systems described above for removing the cores of depleted reels lies in the fact that they do not allow the removal or extraction of cores of reels having a reduced thickness and therefore with an external diameter less than or almost equal to the internal diameter of the supporting element. In this case, in fact, during the lowering of the reel holder shaft, the core would also be inserted inside the supporting element or in any case it would fit on the upper peripheral edge of the latter without being able to be removed. Even in the case of cores with an external diameter slightly greater than the internal diameter of the supporting element, the upper peripheral edge of the latter would not be able to support the core in a stable and reliable manner, in particular in the case in which the latter, typically made of cardboard, has a deformed or undamaged lower end.

However, the use of a supporting element having a reduced internal diameter to support smaller cores would require the use of supporting arms of the reel holder shaft of necessarily reduced length to allow it to be inserted into the supporting element in the open configuration. However, arms of reduced extension or length would not ensure a stable and reliable support of the film reel, especially in the case of reels with thicker core and/or with damaged, deformed lower end. In fact, in these cases the reel may move along the reel holder shaft and even exit.

It is therefore necessary to mount supporting elements and supporting arms on the removing apparatus and on the wrapping machine, respectively, commensurate with the dimensions (thicknesses) of the cores of the film reels used.

These changes, in addition to requiring the wrapping machine to stop, are expensive and require time and skilled labour.

Another disadvantage of the known systems is that the insertion of the reel holder shaft inside the supporting element requires a great deal of precision and accuracy in order to avoid collisions between the lower end of the reel holder shaft and the upper edge of the supporting element, collisions which could damage one or both components.

An object of the invention is to improve the known wrapping machines provided with systems configured to remove a core or central element of a depleted film reel from a reel holder shaft of the machine.

Another object is to provide a wrapping machine having a system which allows to remove reel cores having different thicknesses, even small, without modifying the reel holder shaft.

A further object is to provide a wrapping machine having a system for removing reel cores which is inexpensive, safe and reliable.

These and further objects are achieved by a wrapping machine according to one or more of the claims set out below.

The invention can be better understood and implemented with reference to the attached drawings which illustrate exemplifying and non-limiting embodiments thereof, in which.

Figure 2:
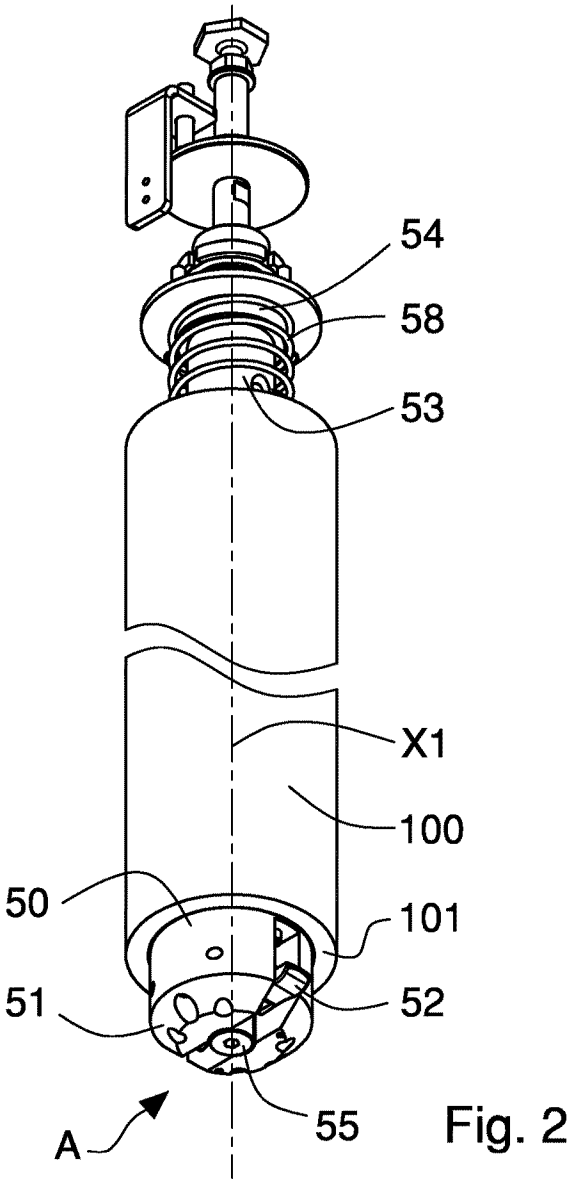
FIG. 2 is an perspective broken view of the reel holder shaft of the wrapping machine of FIG. 1 having a reel core spaced apart by abutment arms arranged in an open configuration.

With reference to FIGS. 1 to 10, a system 1 of the wrapping machine 200 of the invention is illustrated, configured to remove a core 100 of film reel from a reel holder shaft 50 of an unwinding apparatus 80 of said wrapping machine 200. The wrapping machine 200, illustrated in FIGS. 9 and 10 by way of example and not of limitation, is for example a horizontal rotating ring machine of a known type, and the unwinding apparatus 80 is also of a known type and comprises film unwinding and pre-stretching rollers and a reel holder shaft 50.

The reel holder shaft 50 is rotatably fixed to the unwinding apparatus 80 and is configured to support a film reel.

The system 1 comprises a removing apparatus 2 adapted to receive from the reel holder shaft 50 and remove therefrom a core 100 of a depleted film reel.

The reel holder shaft 50 comprises a lower end 51 provided with one or more abutment arms or brackets 52 angularly spaced about a first longitudinal axis X1 of the reel holder shaft 50 and movable between an open configuration A for abutting and supporting the core 100 mounted on the reel holder shaft 50 and a closed configuration B for allowing to remove, or insert, the core 100 from/into said reel holder shaft 50.

In the embodiment illustrated in FIGS. 1-8 by way of example and not of limitation, the reel holder shaft 50 of the wrapping machine comprises two abutment arms 52 positioned diametrically opposite at the lower end 51 and mounted rotatably about respective axes parallel to each other and orthogonal to the first longitudinal axis X1. The first longitudinal axis X1 is the rotation axis of the reel holder shaft 50 and is substantially vertical.

However the lower end 51 of the reel holder shaft 50 can be provided with a single abutment arm 52 rotatable about a respective axis orthogonal to the first longitudinal axis X1 or can be provided with three or more abutment arms 52 arranged angularly and regularly spaced about the first longitudinal axis X1 and rotatably mounted about respective axes parallel to each other and orthogonal to the first longitudinal axis X1.

The removing apparatus 2 comprises a supporting element 3 provided with a side wall 4 which forms an internal cavity 6, in particular substantially cylindrical, having an upper opening 7 and an upper peripheral edge 8 which bounds the aforesaid upper opening 7 and forms a flat supporting surface adapted to abut and maintain raised the core 100 when the lower end 51 of the reel holder shaft 50 is inserted into the internal cavity 6 in a removing configuration E with the abutment arms 52 disengaged and/or spaced from the core 100.

The side wall 4 of the supporting element 3 comprises a plurality of elastic elements 14 arranged angularly spaced about and parallel to a second longitudinal axis X2 of the supporting element 3 so as to form with their respective central portions 15 the internal cavity 6 having a first internal diameter D1 greater than a first transverse dimension L1 of the lower end 51 with the abutment arms 52 arranged in the open configuration A.

The second longitudinal axis X2 is a longitudinal symmetry axis of the supporting element 3 and is substantially vertical.

The elastic elements 14 also comprise respective upper portions 16 shaped so as to form the upper peripheral edge 8 and the upper opening 7, the latter having a second internal diameter D2 that is almost equal to an internal diameter Di of the core 100.

The second diameter D2 of the upper opening 7 is preferably wider than a second transverse dimension L2 of the lower end 51 with the abutment arms 52 arranged in the closed configuration B. The second transverse dimension L2 is smaller than an internal diameter Di of the core 100.

The elastic elements 14 are configured to elastically bend, in particular towards the outside, i.e. away from the second longitudinal axis X2, and to open wide when abutted by the abutment arms 52 in the open configuration A so as to allow inserting the lower end 51 into the internal cavity 6. The elastic elements 14 when disengaged from the abutment arms 52 return to the initial non-bent configuration.

Each elastic element 14 has an elongated shape, in particular in a direction parallel to the second longitudinal axis X2, and a constant thin thickness. Each elastic element 14 is for example an elongated lamina or thin sheet of rectangular section.

The flexible elements 14 are made of an elastic metal alloy, for example spring steel.

Each elastic element 14 comprises a lower end portion 15*a*, connected to the central portion 15 and opposite the upper portion 16, fixed to a base 5 of the supporting element 3 to allow said elastic element 14 to elastically bend on a respective bending plane passing through the second longitudinal axis X2.

The upper portion 16 of each elastic element 14 is folded internally towards the second longitudinal axis X2 so forming a respective contacting wall 16*a* arranged to be abutted by the abutment arms 52, in particular in the open configuration A, during the insertion of the lower end 51 of the reel holder shaft 50 into the internal cavity 6, and a flat supporting wall 16*b* arranged to abut and support the core 100, in particular a lower end 101 of the latter. The contacting walls 16*a* and the supporting walls 16*b* of the plurality of elastic elements 14 form respectively the upper opening 7 and the upper peripheral edge 8 of the supporting element 3.

Each supporting wall 16*b* has dimensions such that the upper peripheral edge 8 thus obtained, which forms a kind of flange, has a width equal to or greater than a wall thickness of the core 100.

The contacting wall 16*a* and the supporting wall 16*b* of the upper portion 16 of each elastic element 14 are respectively almost parallel and almost perpendicular to the second longitudinal axis X2.

The upper portion 16 of each elastic element 14 further comprises an inclined section 16*c* interposed between the contacting wall 16*a* and the supporting wall 16*b* and converging towards the base wall 5. The inclined sections 16*c* of the upper portions 16 of the plurality of elastic elements 14 form a draft wall or portion which facilitates insertion of the lower end 51 of the reel holder shaft 50 into the internal cavity 6 of the supporting element 3.

In the removing configuration E, the upper portions 16 are adequately spaced apart from the abutment arms 52 to allow the latter to be freely rotated inwards without collisions, towards the first longitudinal axis X1 in the closed configuration B.

The two abutment arms 52 are rotated between the open configuration A and the closed configuration B by a driving shaft 53 passing inside the reel holder shaft 50 and moved along the first axis X1 by actuating means of a known type and not illustrated, acting on an upper end portion 54 of said driving shaft 53.

Figure 7:
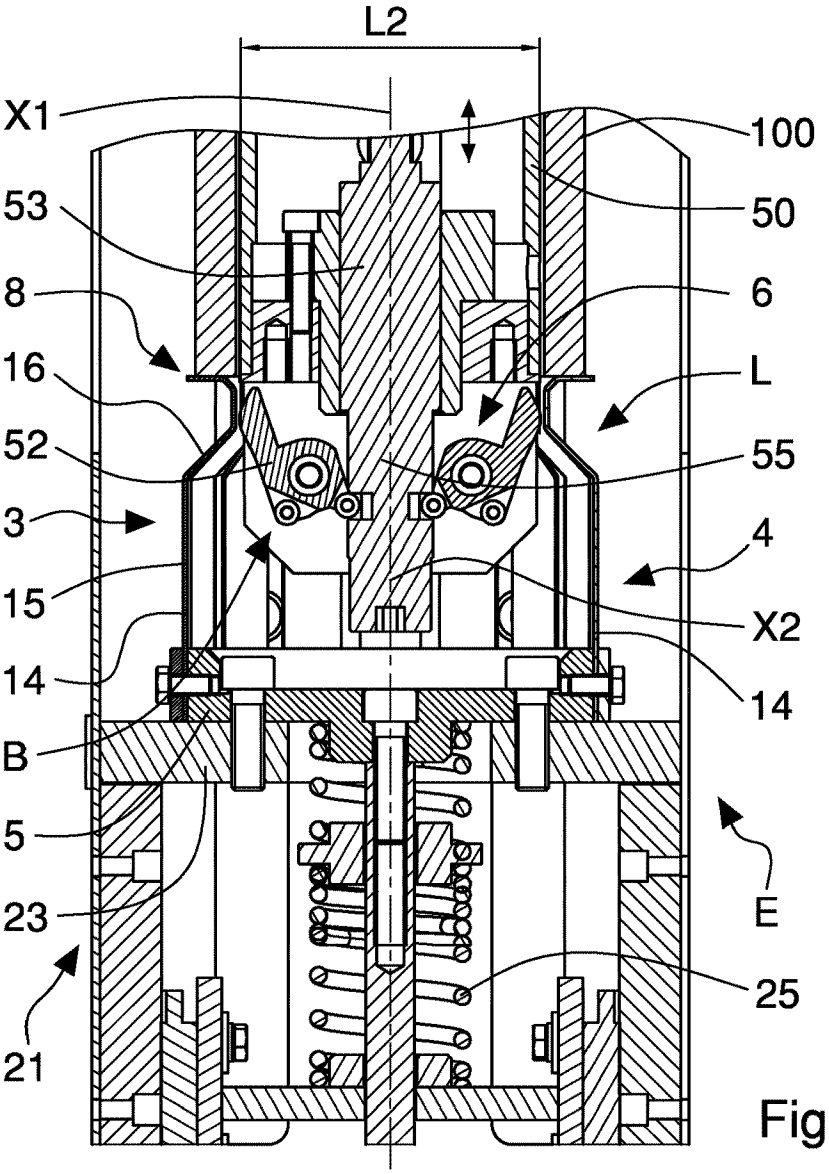
FIG. 7 is a cross-section like that of FIG. 6 in which the abutment arms are in a closed configuration.
Figure 6:
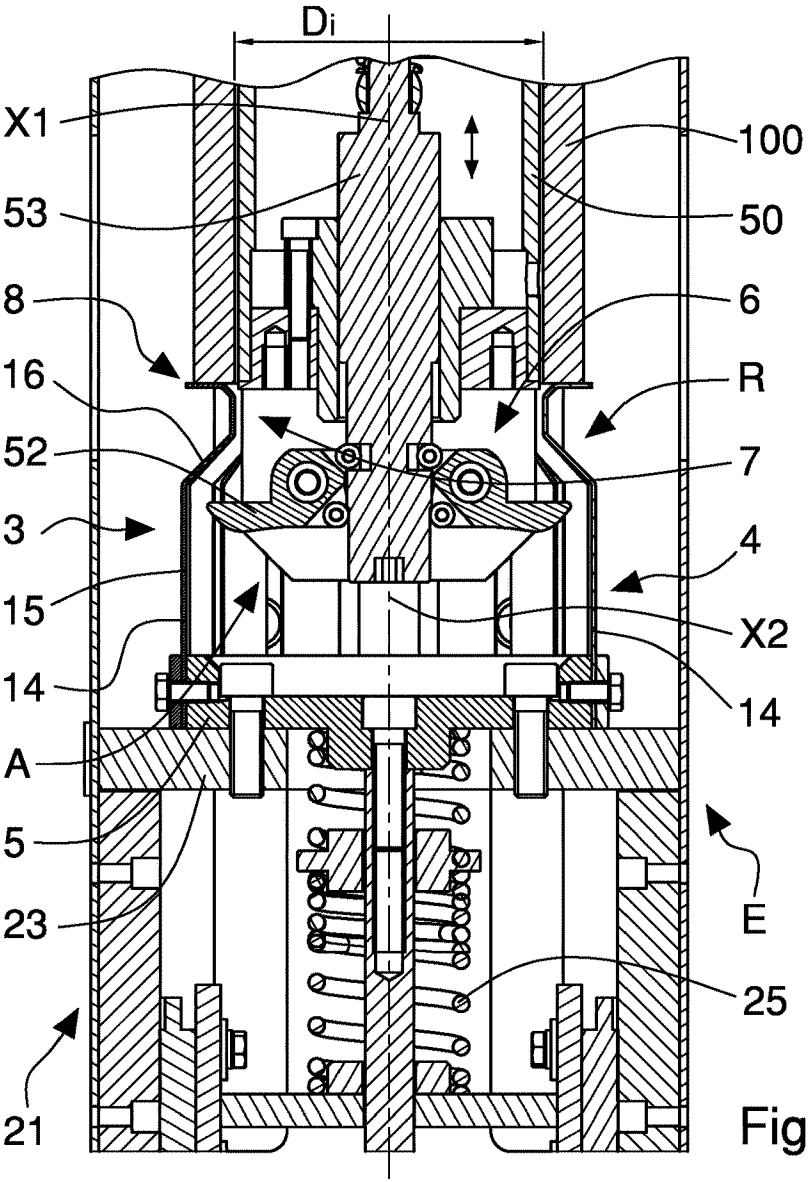
FIG. 6 is a partial section according to line VI-VI of FIG. 5 that illustrates in particular the supporting element and a lower end of the reel holder shaft with abutment arms supporting the reel core in the open configuration.
Figure 8:
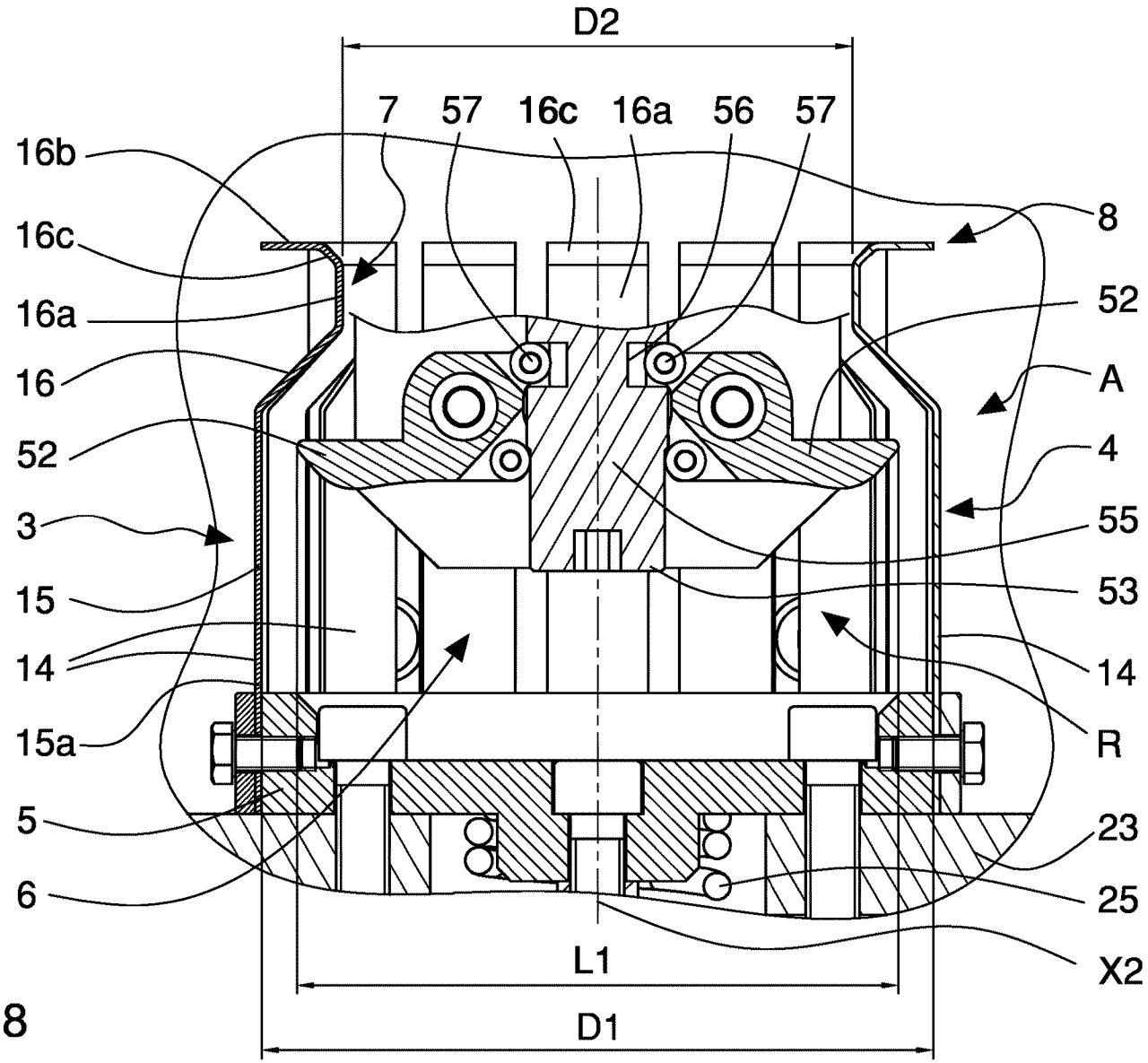
FIG. 8 is an enlarged detail of section of FIG. 6 in which some parts have been removed to better highlight others.
Figure 9:
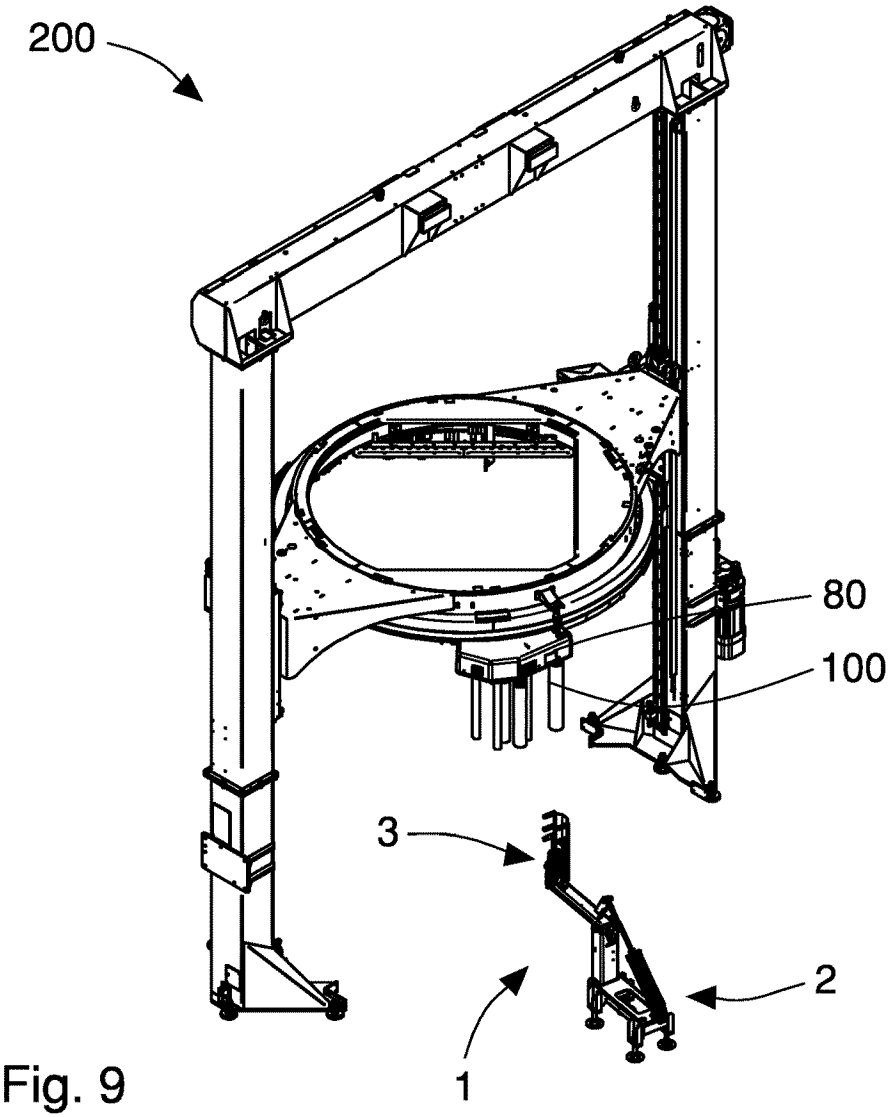
FIG. 9 is a perspective view of the wrapping machine of the invention with the reel holder shaft spaced apart from the removing apparatus.

A lower portion 55 of driving shaft 53 comprises an annular groove 56 in which rollers 57 are engaged that are fixed to the abutment arms 52. Thereby, by linearly moving the driving shaft 53 from a raised position R to a lowered position L and vice versa, the abutment arms 52 are rotated respectively from the open configuration A to the closed configuration B (FIGS. 6 and 7). The driving shaft 53 is maintained in the lowered position by a spring 58 acting on the upper end portion 54.

The removing apparatus 2 further comprises first supporting means 21 arranged to support the supporting element 3, in particular slidably and elastically along the second longitudinal axis X2, and second supporting means 22 adapted to support the first supporting means 21, in particular to move the supporting element 3 in an operating position where it is able to receive the reel holder shaft 51.

The first supporting means 21 comprise a base element 23 to which the supporting element 3 is fixed and which is slidably connected to a first support 24 of the second supporting means 22. The first supporting means 21 also include elastic means 25, for example a coil spring, that are interposed between the first support 24 and the base element 23 and are adapted to maintain the latter in a raised position and allow its lowering in order to absorb a possible downward thrust generated by the insertion of the reel holder shaft 50 in the supporting element 3.

Figure 1:
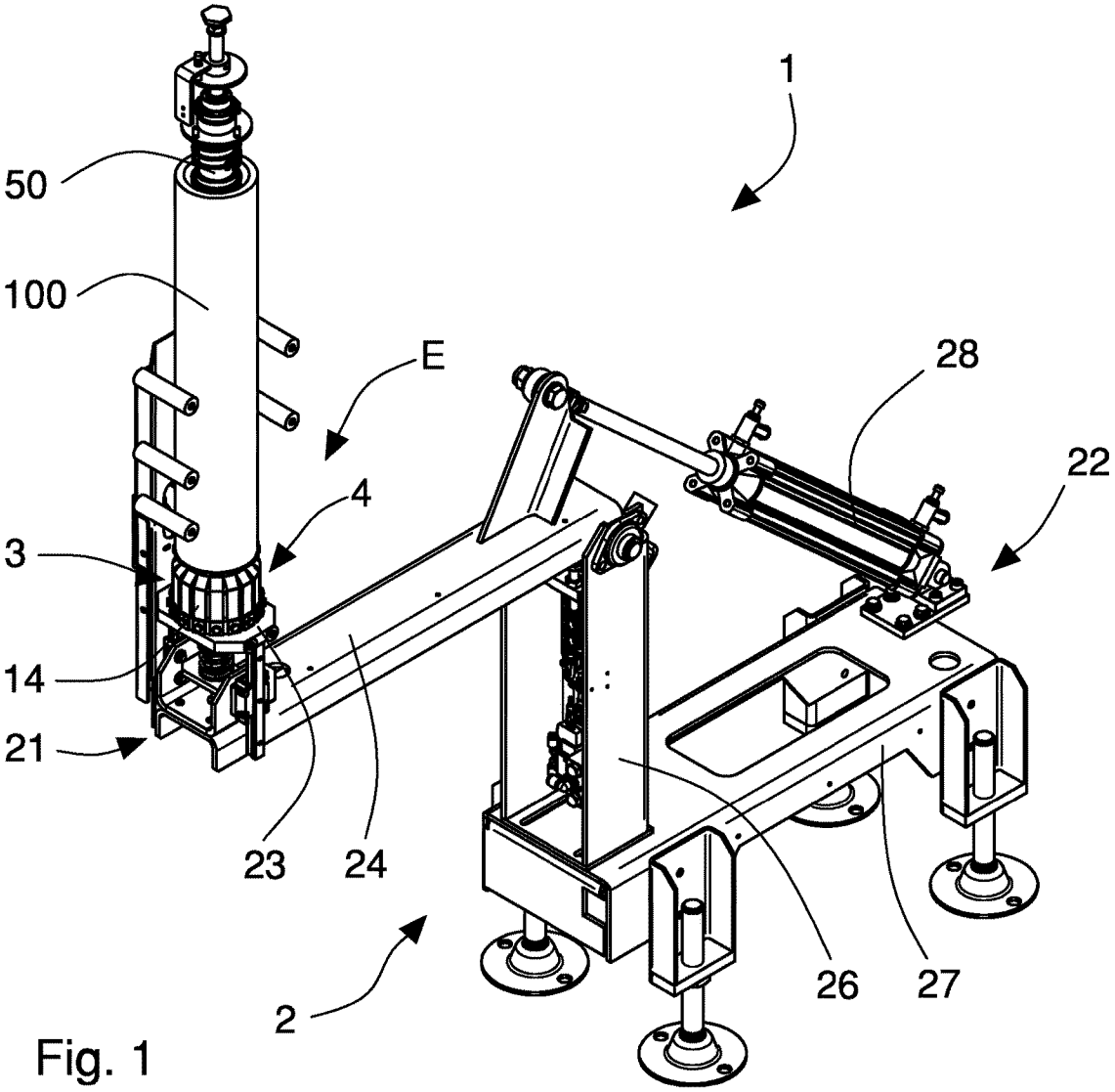
FIG. 1 is a perspective view of a system for removing reel cores of the wrapping machine of the invention in a removing configuration in which a reel holder shaft of the wrapping machine that is provided with a core is inserted into a removing apparatus of the system.
Figure 4:
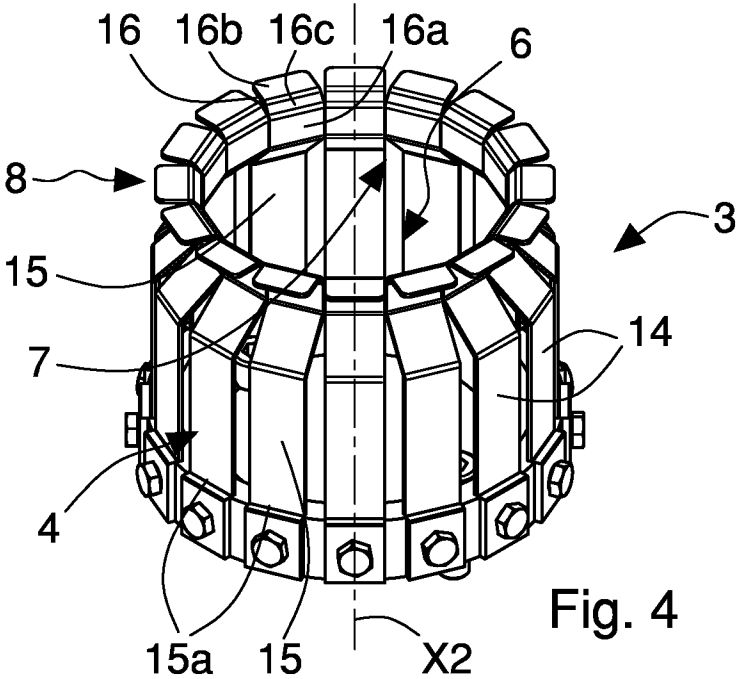
FIG. 4 is an enlarged perspective view of the supporting element of FIG. 3.
Figure 3:
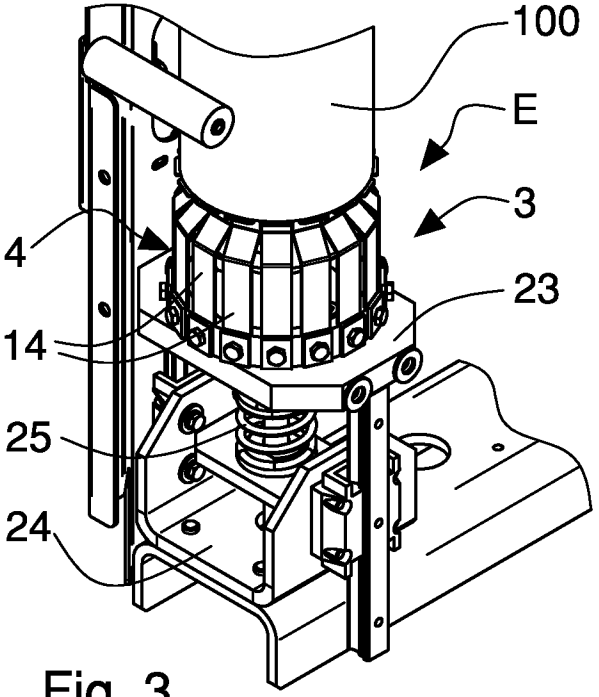
FIG. 3 is an enlarged view of a detail of the removing apparatus of the system of FIG. 1, which in particular illustrates a supporting element on which the reel core rests in the removing configuration.
Figure 5:
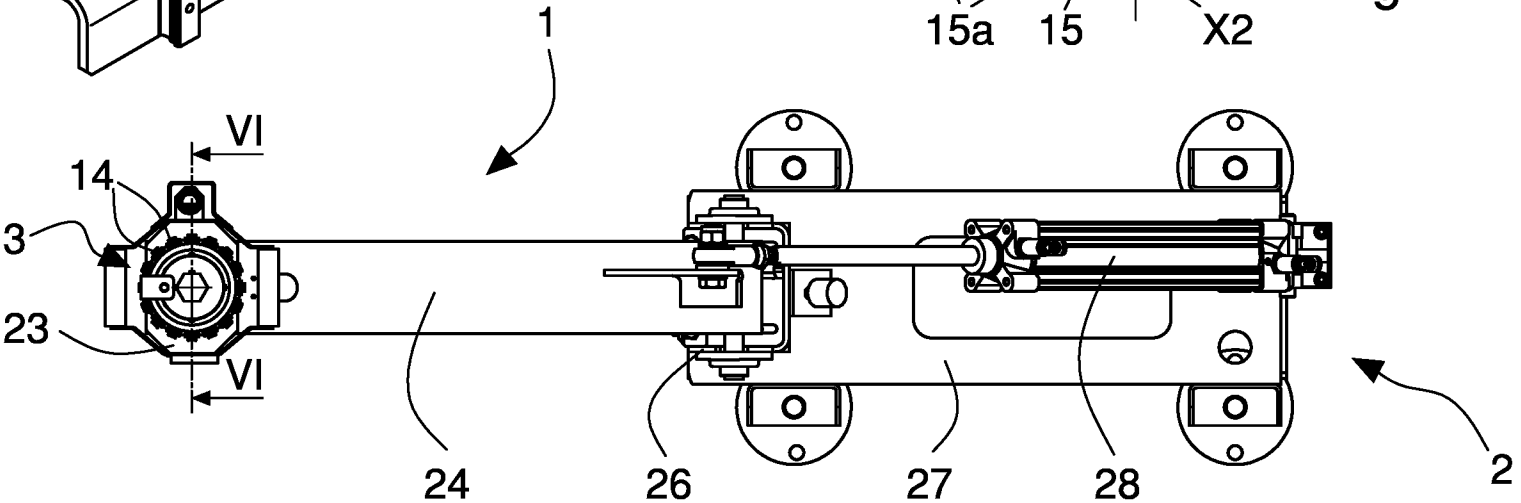
FIG. 5 is a top plan view of the removing apparatus of the system of FIG. 1.

In the embodiment of the removing apparatus 2 illustrated in FIGS. 1 and 5, second supporting means 22 comprise the first support 24 in the form of an elongated arm or beam, a second support 26 elongated, almost vertical, which rotatably supports the first support 24 and is fixed to a platform or base 27 provided with supporting feet.

A linear actuator 28 is fixed to the base 27 and connected to the first support 24 to rotate the latter between an operative position and an inoperative position about an almost horizontal rotation axis.

In the operative position the first support 24 is substantially horizontal and positions the first supporting means 21 with the supporting element 3 inside an operative area of the wrapping machine to allow the reel holder shaft 50 with the core 100 to be inserted into the supporting element 3.

In the inoperative position, the first support 24 is raised in a vertical or inclined position so as to position the first supporting means 21 with the supporting element 3 outside the operating area of the wrapping machine.

Figure 10:
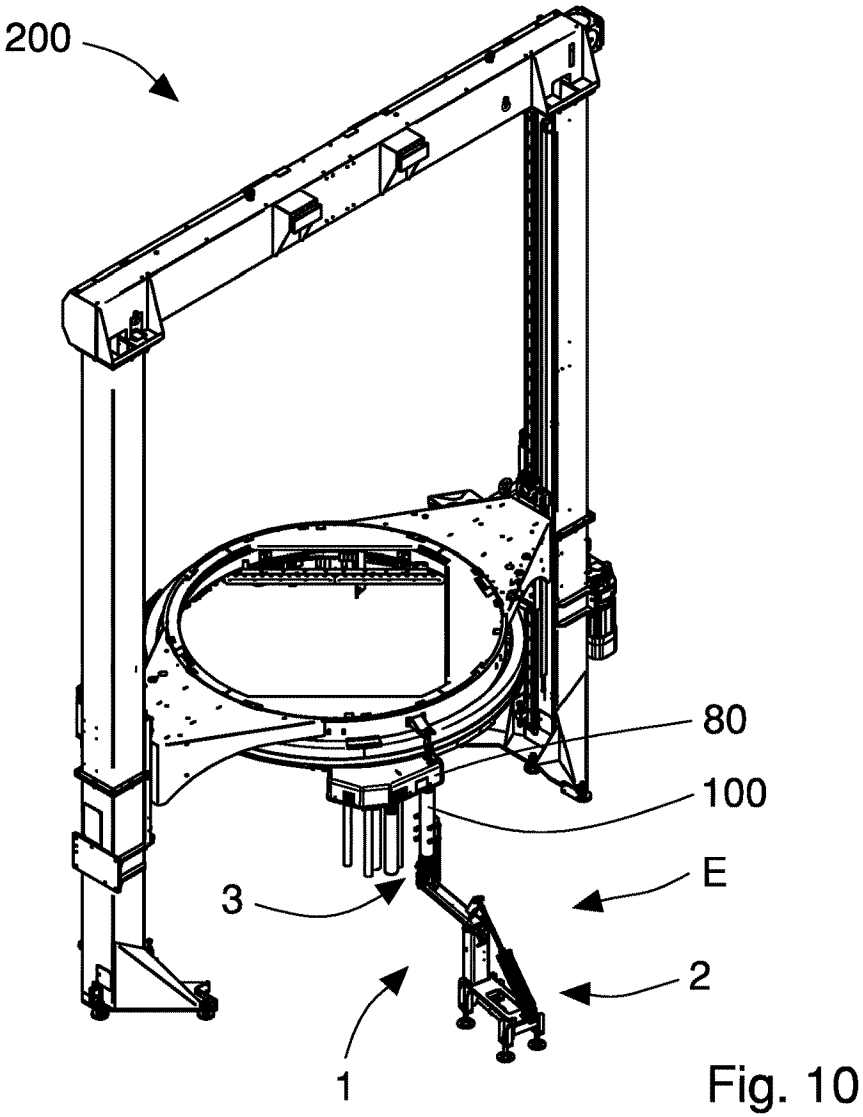
FIG. 10 is a perspective view of the wrapping machine of the invention in the removing configuration.

The operation of the system of the wrapping machine 200 of the invention configured to remove a core 100 of a depleted film reel from the unwinding apparatus 80 of the wrapping machine 200 provides a first insertion step in which the reel holder shaft 50 is lowered so that the lower end 51 thereof is inserted inside the supporting element 3 of the removing apparatus 2 (FIG. 10). To this end, the first support 24 of the second supporting means 22 is arranged in the operative position, such that the reel holder shaft 50 and the supporting element 3 of the removing apparatus 2 are aligned, and in particular the first longitudinal axis X1 of the reel holder shaft 50 and the second longitudinal axis X2 of the supporting element 3 are almost coincident.

The reel holder shaft 50 carries a core 100 of depleted reel which is supported and maintained engaged to said reel holder shaft 50 by the two abutment arms 52 arranged in the open configuration A in which they abut and support a lower end 101 of said core 100.

In the removing configuration E, the lower end 51 of reel holder shaft 50 is inserted into the internal cavity 6 of the supporting element 3 by a length or quantity such as to allow raising the core 100, i.e. disengaging and detaching the core from the abutment arms 52. In fact, the core 100 abuts and is supported by the upper peripheral edge 8 of the supporting element 3, while the lower end of the reel holder shaft 50 with the abutment arms 52 penetrates the internal cavity 6. The upper peripheral edge 8 has dimensions such as to be able to support also cores 100 having small thickness i.e., with a small external diameter. To this end, the upper opening 7 of the internal cavity 6, bounded by the external peripheral edge 8, has a second diameter D2 almost equal to the internal diameter Di of the core 100. The second diameter D2 is therefore smaller than the first transverse dimension L1 of the lower end 51 with the abutment arms 52 arranged in the open configuration A.

The internal cavity 6, which is formed by the side wall 4 which consists of the plurality of elastic elements 14 arranged angularly and regularly spaced about the second longitudinal axis X2, has an internal diameter D1 greater than the first transverse dimension L1 of the lower end 51 with the abutment arms 52 arranged in the open configuration A so as to allow rotating the abutment arms in the closed configuration B and therefore raising the reel holder shaft 50 and disengaging the core 100. To this end, in the removing configuration E, upper portions 16 are adequately spaced from the abutment arms 52 to allow the latter ones to be freely rotated in the closed configuration B without collisions inside, towards the first longitudinal axis X1.

It should be noted that it is possible to insert the lower end 51 of reel holder shaft 50 with abutment arms 52 in the open configuration A into the internal cavity 6 (having an upper opening 7 having a second diameter D2 smaller than the first transverse dimension L1 of the lower end 51) because the side wall 4 of supporting element 3 is made by the plurality of elastic elements 14 that are capable of elastically bending and opening wide when abutted by the abutment arms 52. More precisely, when inserted the abutment arms 52 contact and bend a limited number of elastic elements 14, wherein the remaining, and most of the, elastic elements 14 remain vertical so as to adequately support the core 100. When the lower end 51 is fully inserted into the internal cavity 6, the elastic elements 15 that are bent are disengaged from the abutment arms 52 and return to the non-bent vertical initial position.

In a second removing step of in which the reel holder shaft 50 and the core 100 are removed, the abutment arms 100 are rotated in the closed configuration B by means of the driving shaft 53 which is moved from the raised position R (in which the abutment arms 52 are in the open configuration A) to the lowered position L.

At this point it is possible to lift and remove the reel holder shaft 50 from the supporting element 3 since the second transverse dimension L2 of the lower end 51 with the abutment arms 100 in the closed configuration B is smaller than the internal diameter Di of the core 100 and the latter is fully supported by the supporting element 3.

The second diameter D2 of the upper opening 7 of the internal cavity 6 is preferably wider than the second transverse dimension L2 of the lower end 51 with the abutment arms 52 in the closed configuration B.

Thanks to the system of the wrapping machine of the invention, it is therefore possible to remove cores or central elements of depleted film reels having any thickness, i.e. with different external diameters, from a reel holder shaft of the wrapping machine without the need to modify the reel holder shaft and in particular the abutment arms.

Thanks to the elastic elements 14 forming the side wall 4 of the supporting element 3, it is in fact possible to firmly and safely support cores of film reel having different thicknesses, even thin (e.g. with an external diameter less than 92 mm and an internal diameter of about 75-76 mm), and at the same time interact with reel holder shafts 50 having abutment arms 52 of standard length, configured to adequately support cores of standard thickness (typically with an outer diameter between 95 and 110 mm). In fact, the bending of the elastic elements 4 allows to easily insert the lower end 51 of reel holder shaft 50 with the abutment arms in the open configuration A (for example with a first dimension L1 of about 90 mm) even if the upper opening 7 of the internal cavity 6 has smaller dimensions (for example a diameter D2 equal to the internal diameter Di of the core 100) in order to effectively also support cores of small thickness.

It should also be noted that thanks to the elastic elements 14, which are capable to elastically bend, the insertion of the reel holder shaft 50 inside the supporting element may require less precision and accuracy than that required in the known systems and wrapping machines, since possible collisions between the lower end 51 of the reel holder shaft and the upper peripheral edge 8 of the supporting element 3 do not involve any damage (but only the elastic bending of some elastic elements 14).

Insertion of the reel holder shaft 50 is also facilitated by the draft portion of the side wall 4 that is formed by the inclined sections 16*c* of the upper portions 16 of the plurality of elastic elements 14 converging towards the base wall 5.

The invention claimed is:

1. A wrapping machine comprising:

an unwinding apparatus; and a system for removing a core of a film reel from said unwinding apparatus, wherein said unwinding apparatus comprises a reel holder shaft suitable to support a film reel and having a lower end provided with at least one abutment arm movable between an open configuration to support the core inserted on said reel holder shaft and a closed configuration to allow removing of the core from said reel holder shaft or inserting of the core onto said reel holder shaft, wherein said system comprises a removing apparatus which includes a supporting element provided with a side wall forming an internal cavity having an upper opening and an upper peripheral edge which bounds said upper opening and forms a flat supporting surface adapted for abutting and supporting the core when said lower end of said reel holder shaft is inserted into said internal cavity in a removing configuration with said abutment arm that is disengaged and spaced from the core, wherein said side wall of said supporting element comprises a plurality of elastic elements arranged angularly spaced about and parallel to a second longitudinal axis of said supporting element such that respective central portions of said elastic elements form said internal cavity having a first diameter wider than a first transverse dimension of said lower end with said abutment arm arranged in the open configuration, and wherein said elastic elements comprise respective upper portions shaped so as to form said upper peripheral edge and said upper opening that has a second diameter substantially equal to an internal diameter of the core, said elastic elements being configured to elastically bend and open wide when abutted by said abutment arm in the open configuration in order to enable said lower end to enter said internal cavity.

2. The wrapping machine according to claim 1, wherein each elastic element has an elongated shape and comprises a lower end portion fixed to a base wall of said supporting element to allow said elastic element to elastically bend on a respective bending plane that is parallel to and passing through the second longitudinal axis.

3. The wrapping machine according to claim 1, wherein said upper portion of each elastic element is internally bent towards the second longitudinal axis so as to form a respective contacting wall arranged to abut said abutment arm and a flat supporting wall arranged to abut and support the core, said contacting walls and said flat supporting walls of said plurality of elastic elements forming respectively said upper opening and said upper peripheral edge.

4. The wrapping machine according to claim 3, wherein said contacting wall and said flat supporting wall of said upper portion of each elastic element are respectively substantially parallel and orthogonal to the second longitudinal axis.

5. The wrapping machine according to claim 3, wherein each elastic element has an elongated shape and comprises a lower end portion fixed to a base wall of said supporting element to allow said elastic element to elastically bend on a respective bending plane that is parallel to and passing through the second longitudinal axis, and wherein said upper portion of each elastic element further comprises an inclined section interposed between said contacting wall and said flat supporting wall and converging towards said base wall, said inclined sections of said upper portions of said plurality of elastic elements forming an entering portion of said side wall suitable to facilitate inserting said lower end of said reel holder shaft into said internal cavity of said supporting element.

6. The wrapping machine according to claim 1, wherein said upper peripheral edge has a width equal to or greater than a wall thickness of the core.

7. The wrapping machine according to claim 1, wherein in the removing configuration a distance between said upper portions of said plurality of elastic elements and said abutment arm is such to allow said abutment arm rotating towards a first longitudinal axis of said reel holder shaft in the closed configuration.

8. The wrapping machine according to claim 7, wherein said abutment arm rotates about a respective axis that is orthogonal to the first longitudinal axis.

9. The wrapping machine according to claim 1, wherein the second diameter of said upper opening is wider than a second transverse dimension of said lower end of said reel holder shaft with said abutment arm arranged in the closed configuration.

10. The wrapping machine according to claim 1, wherein said lower end of said reel holder shaft comprises at least two abutment arms that are angularly spaced about a first longitudinal axis of said reel holder shaft and movable between the open configuration and the closed configuration.

11. The wrapping machine according to claim 10, wherein said abutment arms rotate about respective axes that are parallel to each other and orthogonal to the first longitudinal axis.

12. The wrapping machine according to claim 1, further comprising a first supporting assembly for supporting said supporting element in a slidably and elastically way along the second longitudinal axis.

13. The wrapping machine according to claim 12, further comprising a second supporting assembly for supporting said first supporting assembly, and for moving said supporting element in an operative position in which said supporting element can receive said reel holder shaft.

14. The wrapping machine according to claim 13, wherein said first supporting assembly comprises a base element slidably connected to a first support of said second supporting assembly and an elastic assembly that is interposed between said first support and said base element and adapted to maintain said base element in a raised position.

* * * * *